United States Patent [19]

Shaw

[11] 4,079,826

[45] Mar. 21, 1978

[54] PAPER TAPE HOUSING FOR A BUSINESS MACHINE

[75] Inventor: Joseph P. Shaw, Wanaque, N.J.

[73] Assignee: Digital Computer Controls, Inc., Fairfield, N.J.

[21] Appl. No.: 641,011

[22] Filed: Dec. 15, 1975

Related U.S. Application Data

[63] Continuation of Ser. No. 478,249, Jun. 11, 1974, abandoned.

[51] Int. Cl.[2] ..... B41J 15/00

[52] U.S. Cl. ..... 197/133 R; 235/1 D

[58] Field of Search ..... 197/132, 133 R; 235/1 D, 61.9 A, 58 GF, 7 R

[56] References Cited

U.S. PATENT DOCUMENTS

| | | | |
|---|---|---|---|
| 1,362,791 | 12/1920 | Hayes et al. | 197/133 R X |
| 2,160,539 | 5/1939 | Clark | 197/133 R X |
| 3,033,339 | 5/1962 | Simms | 197/133 R |
| 3,294,212 | 12/1966 | Gearheart et al. | 197/133 R |
| 3,476,230 | 11/1969 | Hunter | 197/133 R |
| 3,572,601 | 3/1971 | Miller | 197/133 R X |
| 3,593,833 | 7/1971 | Bretti | 197/132 |
| 3,644,930 | 2/1972 | Stange et al. | 197/133 R X |
| 3,793,951 | 2/1974 | Denley | 197/133 R X |

*Primary Examiner*—Edward M. Coven

*Attorney, Agent, or Firm*—Stephen E. Feldman; Marvin Feldman

[57] ABSTRACT

The paper tape roll, utilized for providing a printed customer receipt, is disposed in a trough like tray housed behind a drop-down door hinged in the front wall (i.e. the surface facing the machine operator during normal use of a business machine such as a cash register or the like). The path of tape feed progresses from the roll vertically up into a paper feed mechanism arranged in clear view of and for easy access by the machine operator while the operator remains in normal machine use position. The paper tape is then guided by the paper feed mechanism through a receipt printer, below a cutting blade, and out through a window, also provided in the drop-down door, for ready extraction by the machine operator and subsequent delivery to the customer.

7 Claims, 4 Drawing Figures

PAPER TAPE HOUSING FOR A BUSINESS MACHINE

This is a continuation, of application Ser. No. 478,249, filed June 11, 1974, now abandoned.

BACKGROUND OF THE INVENTION

1. Field of Application

This invention relates to paper tape housings, and more particularly to a housing for positioning a paper tape roll in a business machine for subsequent ready and easy threading into the tape feed and printing mechanisms.

2. Description of Prior Art

The great majority of business machines, such as cash registers, calculating machines, accounting machines and the like provide a spindle mounting for their paper tape rolls. More often then not access to the paper tape and spindle is by a door in the side of the business machine. This is especially true for cash registers.

When the paper tape is to be replaced the machine operator must gain access to the paper tape housing, remove the depleted tape roll from the spindle, and place the new roll of tape on the spindle. Thereafter the operator must thread the end of the new paper tape into the paper feed machanism, for subsequent passage into and through the receipt printer and out of an exit window or door approximately disposed in the business machine.

For most business machines paper tape replacement is a cumbersome chore; but for cash registers with side access doors to the tape housing the operator must either assume an awkward position to replace and thread the tape or move from the normal machine use position to the side of the register. In the awkward position tape threading becomes all but impossible, while if the operator moves to the side of the register the cash drawer is left unguarded so extra steps of locking and unlocking the register are required. Alternatively the operator may turn the register around but registers are usually too heavy for operators, especially female operators, to move and quite often the register is disposed in a tight space which does not permit any such movement.

Some business machines, such as those shown in U.S. Letter Pat. Nos. 1,362,791 to B. P. Hayes and F. D. Laughlin, 3,476,230 to W. S. Hunter, and 3,593,833 to F. Bretti, avoid the tape on spindle problem by placing the tape roll in a trough like tray. Hunter is not, however, concerned with the complex tape feed and/or receipt dispensing structures associated with calculators and cash registers. The Bretti arrangement awkwardly positions the roll trough so that the access door obstructs sight thereof and access thereto in the normal operator use position for the machine, and so that subsequent threading of the paper tape is also hindered. The Hayes et al configuration still retains the side access door to the cash register with its inherent problems as well as a complex and cumbersome tape feed path.

SUMMARY OF THE INVENTION

It is therefore an object of this invention to provide a new and improved paper tape housing.

It is another object of this invention to provide a new and improved paper tape housing for a business machine or the like.

It is a further object of this invention to provide a new and improved paper tape housing for a business machine such as a cash register or the like.

It is yet another object of this invention to provide a new and improved paper tape housing positioned for access through a door opening towards the machine operator while positioned for normal machine use.

It is yet still another object of this invention to provide a new and improved paper tape housing positioned for access through a door opening towards the machine operator while positioned for normal machine use, and which in addition provides a path for threading of the paper tape which is clearly visible and easily accessable to the machine operator when so positioned.

In carrying out this invention, according to the preferred embodiment thereof, a paper tape housing is provided in that portion of a business machine facing the machine operator while in normal position for machine use. A trough like tray positions the paper tape roll for subsequent direct and easy threading into paper feeding, printing and receipt issuing mechanisms in clear view of the operator while in said normal position for machine use.

Other objects, features, and advantages of the invention in its details of construction and arrangement of parts, will be seen from the above, from the following description of the preferred embodiment when considered in conjunction with the drawings, and from the appended claims.

DESCRIPTION OF THE PREFERRED EMBODIMENT

For convenience, the invention will be described as applied to a paper tape housing for the receipt tape of a cash register having feeding, printing and receipt issuing mechanisms; it being understood, nevertheless that without departing from the scope of this invention that the subject paper tape housing may be provided in a calculating machine or for that matter in any appropriate business machine, that such housing may be for a tally tape as well as for a receipt tape, and that such cash register, calculator or business machine may be provided with a tape take-up mechanism in addition to or in place of said receipt issuing mechanism.

Figure 1:
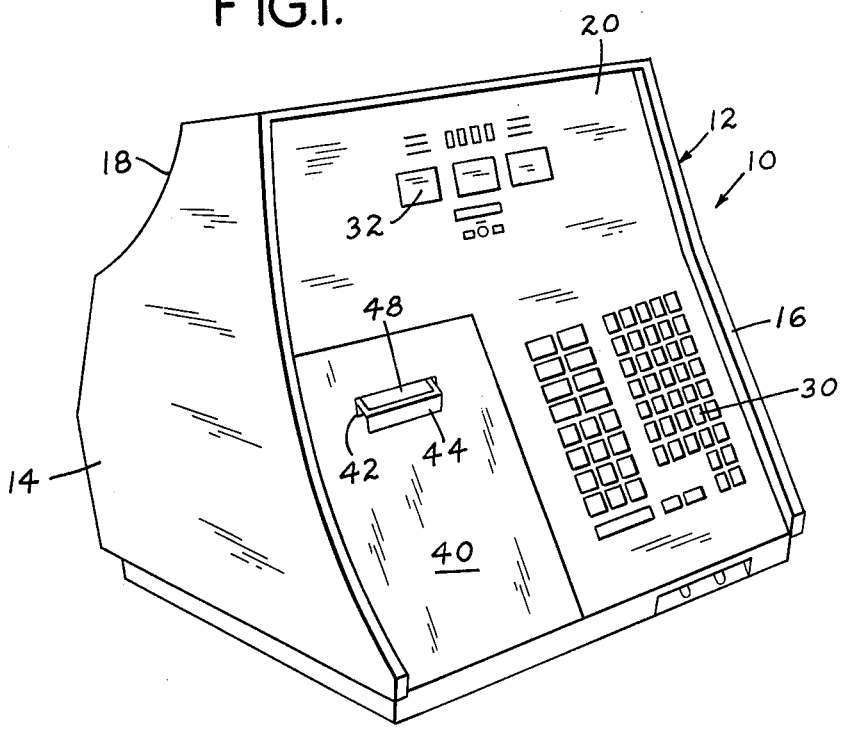
FIG. 1 is a schematic perspective view of a cash register incorporating the instant invention.

With reference to FIG. 1 there is generally shown at 10 a business machine in the form of a cash register. Register 10 is provided with a casing 12 within which the mechanisms usually found in a cash register are arranged for cooperative relationship one with the other. Side walls 14, 16, a rear wall 18 and a front wall 20 make up the consituent parts of casing 12. A bottom surface or wall (not shown) is usually provided for register 10 to completely enclose same but such bottom wall is not usually considered part of casing 12.

Front wall or surface 20 is designated as such because it is the surface facing the machine operator, when the machine operator is positioned for normal use of register 10. A keyboard 30 and indicator mechanism 32 of conventional construction, are situated in front wall 20 of cash register 10. Also located in front wall 20 is a paper and receipt printer housing access door 40 (FIGS. 1 and 2) within which is located a receipt window or door 42 and to which is secured a handle 44.

A portion 48 of a receipt tape roll 50 (FIGS. 1 and 2) extends through window 42 for easy grasping by the machine operator so that a receipt can be given to the customer.

Figure 2:
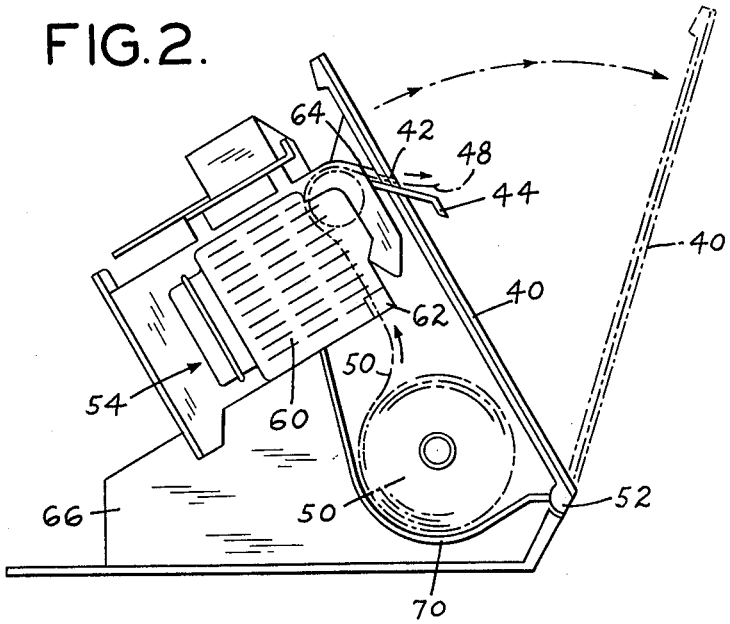
FIG. 2 is a schematic side view of a portion of the cash register of FIG. 1 showing the paper tape in position therein and threaded through schematically shown feeding, printing and receipt issuing mechanisms, thereof.
Figure 3:
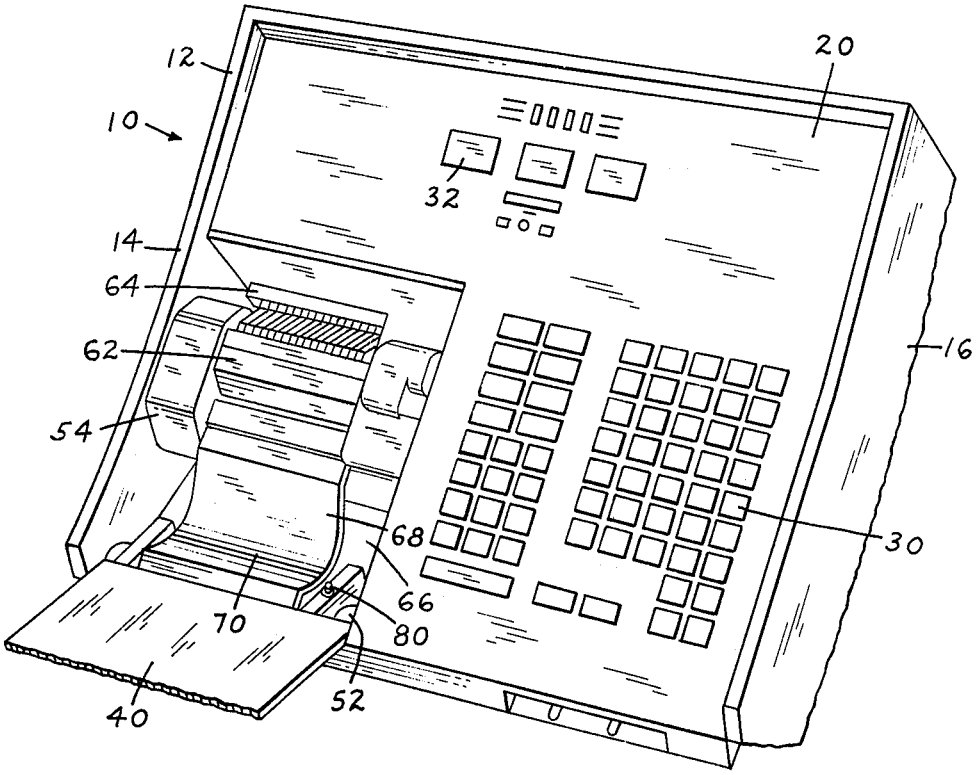
FIG. 3 is a front perspective view of the cash register of FIG. 1 with paper tape roll removed to better show details of tape trough and path to the tape feed, printing and receipt issuing mechanisms.
Figure 4:
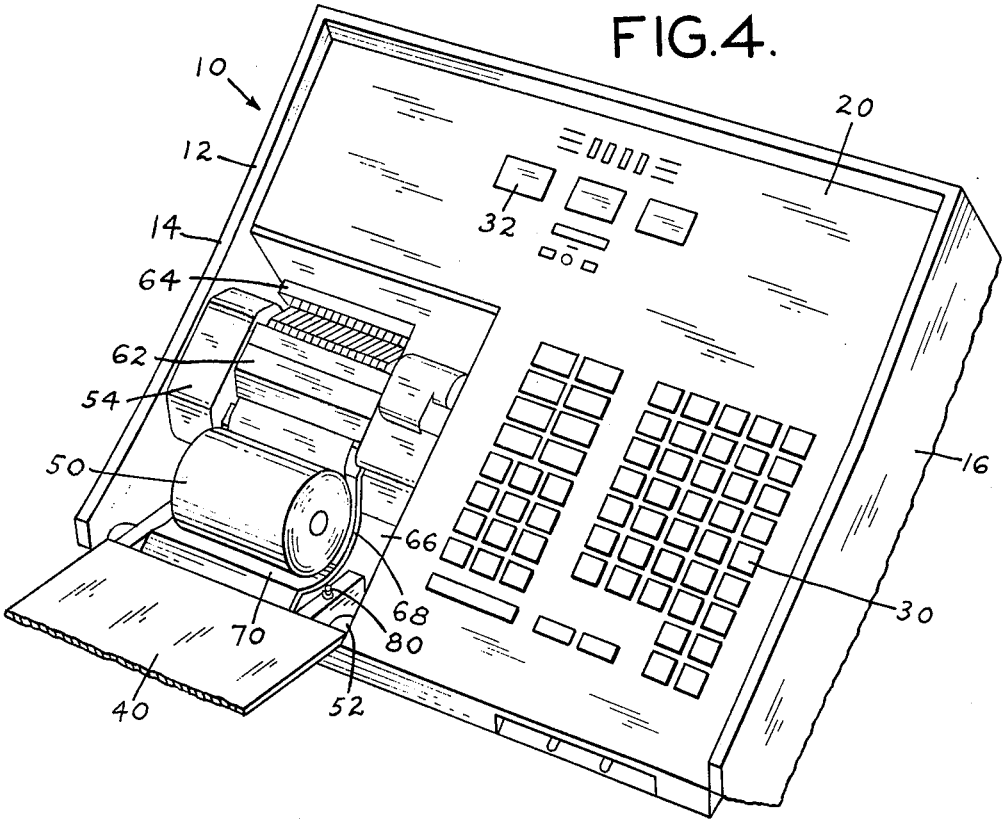
FIG. 4 is front perspective view of the cash register of FIG. 1 showing a roll of tape being threaded into the tape feed, printing and receipt issuing mechanism.

Access door 40 is hinged along its bottom edge as at 52 (FIG. 2) to facilitate movement of door 40 from a closed position as shown in solid lines in FIG. 2, to a fully open position, as shown in FIGS. 3 and 4. In the open position of door 40 a paper and receipt printer housing 54 (FIG. 3) is open to ready and unobstructed access of the machine operator. A suitably proportioned and conventionally available receipt printer 60 (FIG. 2), with attendant paper feed 62 (FIGS. 2 and 3) is carried by a base member 66 (FIGS. 2 and 3) appropriately secured within housing 54. A cut off blade 64 is proximate to door 40. A plate 68 (FIG. 3), carried by base member 66, forms a smooth trough-like tray 70 (FIGS. 2 and 3) for receipt tape roll 50.

Plate 68 also seves to guide the paper tape from roll 50 into the opening of paper feed 62 which is disposed vertically over roll 50 and in clear view of and easy access to the machine operator, in the machine operators normal position for using cash register 10.

Once the paper tape from roll 50 is under control of paper feed 62 it progresses through receipt printer 60 beneath cut-off blade 64 to have its end portion 48 exposed and accessable through window 42.

During the normal use of cash register 10 each transaction is printed upon the paper tape from roll 50 and end portion 48 will be advanced further and further through window 42.

When transactions for a particular customer are finished, and the sale totalled by appropriate operation of register 10, the paper is manually severed by the operator by pulling it against the fixed blade. The receipt is given to the customer and register 10 is ready for the next customer.

The paper tape on roll 50 will eventually run out and subsequent operation of register 10, if a receipt is to be issued, dictates that a new roll 50 be inserted. The machine operator will usually be given some kind or warning that the paper on roll 50 is nearly depleted. This is often done by applying a stripe or area of color near the end portion of the paper on roll 50. The number of times roll 50 needs to be replaced depends upon the extent of use of register 10. It should be appreciated that the more often replacement of roll 50 is required, the more important it is that such replacement be easily accomplished. This is especially so since each replacement of roll 50 also requires that the paper tape from roll 50 be threaded into paper feed 62; such threading must therefore also be easily accomplished if speedy servicing of customers by the machine operator is the criteria.

When the machine operator becomes aware that roll 50 needs replacement they must obviously complete the transaction then in register 10. Thereafter the operator need only grasp handle 44 to rotate access door from its closed position (FIG. 1) to its open position (FIG. 3). There will usually be some paper left extending from roll 50 into paper feed 62. This is removed by first tearing the paper tape completely across its width just below the place where the tape enters paper feed 62 (FIG. 2) Depleted roll 50 may then be discarded.

After a full paper tape roll 50 is laid into tray 70 its end portion is threaded into paper feed 62 (FIG. 4). This is easily accomplished because across door 40 opens the entire housing 54 to the register operator (without the operator having to move), and because the opening to paper feed 62 is disposed vertically over tray 70 and is easily accessable to the register operator. Once the end portion of the paper is so threaded a paper advance button 80 (FIGS. 2 and 3) located to the right of the tray secured to the base (for easy access by the operator) is depressed. Such action starts up paper feed 62 and is continued until the paper tape progresses through printer 60, below cut-off blade 64 and out window 42. At this time button 80 should be released and paper feed 62 deactivated. Register 10 may also be provided with other keys for activating and deactivating paper feed 62 to thread the paper tapes from roll 50. Register 10 is now ready for its next transaction.

If desired the paper from roll 50 may be rewound upon a suitable rewind mechanism located within register 10. In such a situation it would be conventionally referred to as a tally roll.

From the above description it will thus be seen that a novel and improved paper tape housing has been provided for a business machine, or the like, which housing: positions the paper tape roll just behind an access door in the face of the business machine and within easy reach by the machine operator in their position for normal machine use; disposes the paper tape roll in a trough-like tray obviating the sometimes tricky and often obnoxious spindle mounting; and arranges the paper tape roll just under the paper feed opening and clearly visible and easily accessable to the machine operator to facilitate tape threading into the machine.

It is understood that although I have shown the preferred form of my invention that various modifications may be made in the details thereof without departing from the spirit as comprehended by the following claims:

I claim:

1. A business machine or the like comprising:

(a) a casing for said business machine for enclosing component mechanisms thereof and having a front wall containing a keyboard;

(b) an opening in said front wall;

(c) a door for said opening carried by said casing so that in a first position of said door said door blocks access through said opening into said casing, and in a second position of said door access through said opening into said casing is permitted;

(d) a trough-like paper tray fixedly disposed in said casing in proximity to said opening in said casing and with no components of the business machine between said trough-like paper tray and said opening in said casing so that there is easy access to said trough-like paper tray when said door is in said second position; said trough-like paper tray being positioned to hold a roll of paper with its axis parallel to the plane of the front wall; there being no spindle positioned to pass through the roll of paper;

(e) business machine mechanism located so as to normally remain in fixed position within said casing, in proximity to said trough-like paper tray and said opening in said casing, and with no components of the business machine between at least a predetermined portion of said business machine and said opening in said casing so that there is easy access to said business machine when said door is in said second position;

(f) said predetermined portion of said business machine including an opening defining a feed path for paper to enter into said business machine mechanism and being disposed in proximity to said trough-like paper tray with no components of the business machine therebetween to define with said trough-like paper tray an unobstructed paper feed path such that when a roll of paper tape, formed from a rolled up strip of paper is disposed in said trough-like paper tray the strip of paper may move along said predetermined paper feed path from said trough-like tray to be threaded into said opening in said predetermined portion of said business machine mechanism;

(g) threading of said paper tape into said opening of said business machine mechanism being accomplished by access through said opening in said surface of said casing when said door is in said second position.

2. The business machine of claim 1 wherein said opening in said business machine mechanism is vertically disposed a short distance above said trough-like tray.

3. The business machine of claim 1 wherein said door is hinged to said casing.

4. The business machine of claim 3 wherein said door rotates about said hinge in a horizontal direction away from the business machine and down.

5. The business machine of claim 1 wherein said door is formed with an opening to permit egress of the receipt portion of a paper tape roll when provided by the business machine.

6. The business machine of claim 1 wherein said predetermined position for said opening is in the lower left hand section of said predetermined surface.

7. The business machine of claim 1 wherein said business machine mechanisms within the business machine are cash register mechanisms.

* * * * *